US008794251B2

(12) United States Patent
Østervold et al.

(10) Patent No.: US 8,794,251 B2
(45) Date of Patent: Aug. 5, 2014

(54) METHOD AND CLEANING EQUIPMENT FOR CLEANING SURFACES BELOW WATER LEVEL

(76) Inventors: Tor Mikal Østervold, Bekkjarvik (NO); Sten Terje Østervold, Bekkjarvik (NO)

( * ) Notice: Subject to any disclaimer, the term of this patent is extended or adjusted under 35 U.S.C. 154(b) by 627 days.

(21) Appl. No.: 12/736,815

(22) PCT Filed: May 18, 2009

(86) PCT No.: PCT/NO2009/000188

§ 371 (c)(1),
(2), (4) Date: Nov. 12, 2010

(87) PCT Pub. No.: WO2009/142506

PCT Pub. Date: Nov. 26, 2009

(65) Prior Publication Data

US 2011/0100400 A1 May 5, 2011

(30) Foreign Application Priority Data

May 19, 2008 (NO) ..... 20082276
Oct. 28, 2008 (NO) ..... 20084538

(51) Int. Cl.

| | |
|---|---|
| ***B08B 3/02*** | (2006.01) |
| ***B08B 3/04*** | (2006.01) |
| ***B08B 1/04*** | (2006.01) |
| ***B05B 1/20*** | (2006.01) |
| ***B63B 59/10*** | (2006.01) |

(52) U.S. Cl.

CPC ..... *B63B 59/10* (2013.01); *B08B 3/024* (2013.01); *B08B 3/02* (2013.01); *B08B 2203/0229* (2013.01); *B05B 1/207* (2013.01)

USPC ..... 134/199; 134/123; 134/172; 15/322

(58) Field of Classification Search

USPC ..... 134/172, 199; 15/322; 239/214.13, 239/214.15, 222, 223, 224, 735, 738, 747

See application file for complete search history.

(56) References Cited

U.S. PATENT DOCUMENTS

| | | | | |
|---|---|---|---|---|
| 3,184,166 | A * | 5/1965 | Wood | 239/245 |
| 4,168,562 | A * | 9/1979 | Maasberg | 15/320 |
| 5,268,271 | A | 12/1993 | Seijas | |
| 5,628,271 | A * | 5/1997 | McGuire | 114/222 |
| 6,315,648 | B1 * | 11/2001 | Neer | 451/92 |
| 6,360,965 | B1 * | 3/2002 | Clearman et al. | 239/222.19 |

FOREIGN PATENT DOCUMENTS

| | | |
|---|---|---|
| JP | 61-159372 | 7/1986 |
| JP | 1-151885 | 10/1989 |
| JP | 5-124398 | 5/1993 |
| JP | 8-269885 | 10/1996 |
| JP | 9-221099 | 8/1997 |
| JP | 2001-293440 | 10/2001 |
| WO | WO 2007/105303 | 9/2007 |

* cited by examiner

*Primary Examiner* — Michael Kornakov
*Assistant Examiner* — Natasha Campbell
(74) *Attorney, Agent, or Firm* — Francis C. Hand; Carella, Byrne, et al

(57) ABSTRACT

The washing apparatus employs a cup with integrated channels for the supply of fluid to integrated spraying nozzles arranged around the rim of the cup and with a central outlet at the top of the cup for removal of fluid and fouling material.

10 Claims, 7 Drawing Sheets

METHOD AND CLEANING EQUIPMENT FOR CLEANING SURFACES BELOW WATER LEVEL

The present invention relates to a method and washing tools for cleaning of underwater surfaces, loosening of fouling material and suction of the material.

Furthermore, the invention relates to application of the washing tools.

It is an aim of the invention to provide a construction to carry out cleaning and suction of polluting materials that can be found on surfaces under water. Furthermore, it is an aim to be able to suck up the fouling material that is sprayed loose from the surfaces so that it is not released into the body of free water.

With surfaces is meant, in this connection, underwater surfaces on ships' hulls, platforms, concrete constructions, tanks, harbour constructions and other types of constructions that lie under water and the like. With the invention one aims in particular to treat the underwater surfaces of hulls of ships.

Furthermore, the invention can be used for cleaning with collection and removal of polluted sludge from the ocean bed in harbour installations in shallow ocean areas, canals, straits and the like.

Solutions are known where underwater surfaces are cleaned with the help of apparatus with nozzles that are directed at the surface and by spraying with fluids, such as seawater, to loosen the fouling material, for example, with the help of high pressure flushers. Such fouling material can be growths, algae, shells and the like that will always attach to underwater surfaces such as the hulls of ships. Fouling material can also be primer, loose flakes of paint and the like which one wants to remove from the part of the submerged hull.

With regard to prior art, reference is made to the following patent publications: U.S. Pat. No. 4,168,562, CH679.131, U.S. Pat. No. 4,926,775, U.S. Pat. No. 6,896,742 and U.S. Pat. No. 5,628,271.

There is only one of these publications that describes a construction to be used under water, U.S. Pat. No. 4,926,775 which thereby represents the closest prior art for the present invention. The other patents describe different cleaning machines including rotating and non-rotating elements that spray out cleaning fluids and they are not used for cleaning of surfaces under water.

According to the above mentioned U.S. Pat. No. 4,926,775 a cup with spraying nozzles is directed towards the surface that is to be cleaned, and the nozzles are fastened on a disc that can rotate, and cleaning fluid is supplied so that they start rotating and they spray the liquid at a high pressure against the surface so that the fouling material comes loose. However, it is not clear how the loosened fouling material is taken care of. It seems as if it is led away out into the surrounding body of water and distributed as a pollutant. Thus, the fouling material and the water are not properly collected, treated and cleaned in a proper manner in a controllable system, as is the intention with the present invention.

The disadvantage with some of the previously known solutions is that the fouling material is not collected and deposited in a proper manner but is released out into the surrounding body of water, which, for example:

- results in biological pollution inside a partially enclosed harbour area
- and leads to spreading of marine microorganisms which are a part of the growth and which can be damaging (for example, predatory microorganisms) for the marine environment of the area if they are released into the water.

- Loosens primer that may contain chemicals that are very harmful to the marine environment.

It is an object of the invention to provide a new construction of two different versions for loosening and removal of fouling material from underwater surfaces of the type that is mentioned above.

With the invention one also aims for a solution where the sucked up fluid is treated with UV radiation so that the microorganisms are killed and the water can be let back into the sea.

The method according to the invention is characterised in that a washing tool is used where each washing apparatus is in the form of a cup with integrated channels for supply of fluid to integrated spraying nozzles for the fluid around the rim edge of the cup, and with a central outlet at the top of the cup for sucking out fluid and fouling material, and the cleaning is carried out as follows:

- The construction is brought up to the surface with the cup/rim edge of the cups at a distance from the surface
- a suction (a fluid dynamic underpressure) is created in the outlet of the cup(s), said suction contributes to extract water from the environment outside in below the rim of the cup, into the inside of the cup and up through the outlet,
- fluid is sprayed out through the nozzles which makes the cup(s) rotate and loosens fouling material from the surface and the mixture of fouling material and water flows into the already established stream of water in towards the center and up towards the top inside of the cup where the established suction is the strongest, and
- the mixture of the fouling material and water is led away for said further treatment.

The cup nozzles preferably end up at the lower rim edge of the cup and are set at an angle in towards the center. According to a second preferred embodiment, jets of fluid are sprayed out, each of which forms a projected angle in the order of 10-90° with the tangents to the rim edge of the cup, and also an angle of the order of 10-80° with a line vertical to the peripheral plane of the rim edge.

According to yet another preferred embodiment the cup construction is set against the surface to be cleaned and a fluid dynamic underpressure (suction) is established so that the ratio between the volume of fluid which is sprayed out through the nozzles and the volume of water that is sucked in from the environment is in the range 1:10 to 5:10.

The cup can be made to rotate with the rim circumference of the cup at a constant distance (A) from the hull surface, said distance being controlled with the help of length adjustable spacers fitted in the frame construction, with each spacer being a rod, the free end of which comprises a fender or a wheel set up to lie against, and move across, the hull surface. The distance (A) can be set in the range 0.1 to 10 cm.

In the embodiment of the method, the integrated spray nozzles in the suction pipe surrounding cup is set at an angle so that the mixture of fouling material and fluid follows the already established flow from the suction in towards the center of the cup. As the established flow leads to the surrounding water being led into the cup and up through the water suction unit, the angle of the nozzles and their spraying effect ensures that the fouling material is loosened and follows the established flow of water up through the center of the cup and further to subsequent treatment.

The starting point for the invention is that a suction is established in the outlet line from the cup such that water from the outside of the cup is pulled in under the rim of the cup, into the cup and is pulled up through the effluent line (the hose) from the top of the cup.

After the initial suction is well established, the spraying starts with cleaning fluid in the form of water (seawater) from the nozzles associated with the cup, and thereby:

a stream of water is established which sprays with great force (high pressure) against the surface that is being cleaned. The force in the high pressure nozzles in the given direction also makes the cup rotate. Furthermore, all the material that has been sprayed loose, in addition to the body of water inside and in the proximity of the outside of the cup, is sucked up in the already established water suction through the inner, centered top of the cup. Furthermore, the water and fouling material is led out of the cup through a hose to further treatment of the fouling material.

The washing tool according to the invention for loosening and removal of fouling material from surfaces is characterised in that each washing apparatus is in the form of a cup with integrated channels for supply of liquid to integrated spraying nozzles which are arranged around the rim edge of the cup, and comprises a central outlet at the top of the cup for pulling out fluid and fouling material, that the cup with the integrated nozzles is set up to rotate as a consequence of the spraying out of fluid, that the rim edge of the cup is arranged to be set up a given distance (A) from the surface, that the outlet is arranged at the top part of the central section of the cup and is connected to a body that can create the sucking out of fluid from the inside of the cup such that fluid can flow into the inside of the cup through the gap (A) between the surface and the rim edge.

The second version of the washing tool is characterised in that each washing apparatus comprises:

a cup with internally arranged rotary arms with spraying nozzles, where the cup is set up to be brought with its rim edge a distance (A) from the surface, means for supply of cleaning fluid to the nozzles for spraying onto the surface to loosen the fouling material and to make the nozzles rotate inside the cup, an outlet at the top part of the central section and which is connected to a suction body that can pull out water from the inside of the cup so that water can flow into the inside of the cup through the gap (A) between the surface and the rim edge.

According to the invention, the method and washing tools (in two versions) are applied to cleaning of surfaces under water, such as hulls of ships and platforms, concrete constructions, tanks, pier constructions and other underwater constructions.

They can also be applied in collection of removal of polluted sludge from the ocean bed in harbour installations in shallow ocean regions, canals, straits and the like.

According to the invention, the cleaning apparatus comprises a number of cup constructions fitted into a trusswork frame. Furthermore, in this frame, bodies in the form of spacers are fitted which set up a given distance between the rim of the cup and the surface that is to be cleaned. The body can be regulated so that said distance can also be regulated, pending on the cleaning task that shall be carried out.

Two identically operating versions of the construction for loosening and removal of fouling material from surfaces are provided by the invention.

The operating mode for the apparatus according to the invention is preferably as follows:

A suction is established that sets in motion a flow of water in towards the center of the cup that corresponds to several times the amounts of water than what is supplied to the cup through the high pressure nozzles when the spraying process starts. This creates a continuous underpressure inside the cup which influences both the content of the cup and the mass of water surrounding the cup.

High pressure spraying with water (seawater) through the nozzles starts, as high pressure fluid is thereby sprayed towards the wanted surface. Fouling material is thereby made loose from the surface and the angle of the nozzles leads to the cup starting to rotate. Thus, the washing effect increases as these rotate over a larger area than stationary nozzles. The rotation and the angle of the nozzles will also lead to all the fouling material being at all times flushed in the direction towards the center of the cup.

Fouling material that has come loose, water from the high pressure nozzles and a part of the water surrounding the cup stream into the cup. As a result of the fluid dynamic underpressure they will be merged with the established stream of water up towards the suction at the top of the cup. From here everything will be sucked in towards the center of the cup whereupon it is sucked through an outlet line (outlet hose) for further treatment.

This stepwise start up of the operation of the apparatus is used regardless of the embodiment of the apparatus.

The essential new feature of the cup construction according to the invention (the first version) is that it is the cup itself which shall rotate, and the nozzles with their supply pipes are permanently fixed (integrated) into the cup itself, or fluid channels are formed inside the cup material up to the mouthpieces that end up at the rim of the cup. The nozzles are further fitted mutually spaced apart around the rim of the cup, and are directed at an angle to set up a fluid movement which is joined with the volume of fluid that flows in from the outside and up to the outlet of the cup.

Furthermore, the cup is rotary mounted in the construction detail through which the fluid inlet and outlet bodies are mounted. The outlet from the cup is therefore arranged centrally in the top part of the cup, its "dome".

Furthermore, the cup has a given distance to the surface via a number of spacer elements connected in the framework with fitted spacer rods each with wheels, or a fender-formed or brush-like cushion or the like which does not hinder inflow of water from the surrounding body of water in under the rim and into the cup.

According to the invention, the washing tool can function optimally when seawater is sprayed out in a rotating cup. At the same time, the water suction stream (in volume) through the cup must be several times higher than the sprayed body of water so that the cup can be moved along an underwater surface without any of the loosened fouling material being spread out in the water outside the working area of the cup, but is sucked into the center of the cup for further treatment.

The invention shall now be explained in more detail with reference to the enclosed figures, in which:

FIG. 1 shows a ship where the side of the hull is being cleaned with the washing tool according to the invention.

FIGS. 2 and 3 show a possible construction of a washing tool with a cup arrangement set into a framework according to the invention in a plane view and a side view, respectively. In this embodiment five of the previously mentioned cleaning cups are connected together. In practice, the whole washing tool is fitted on a so-called ROV, a remote control submersible mini submarine.

Figure 1:
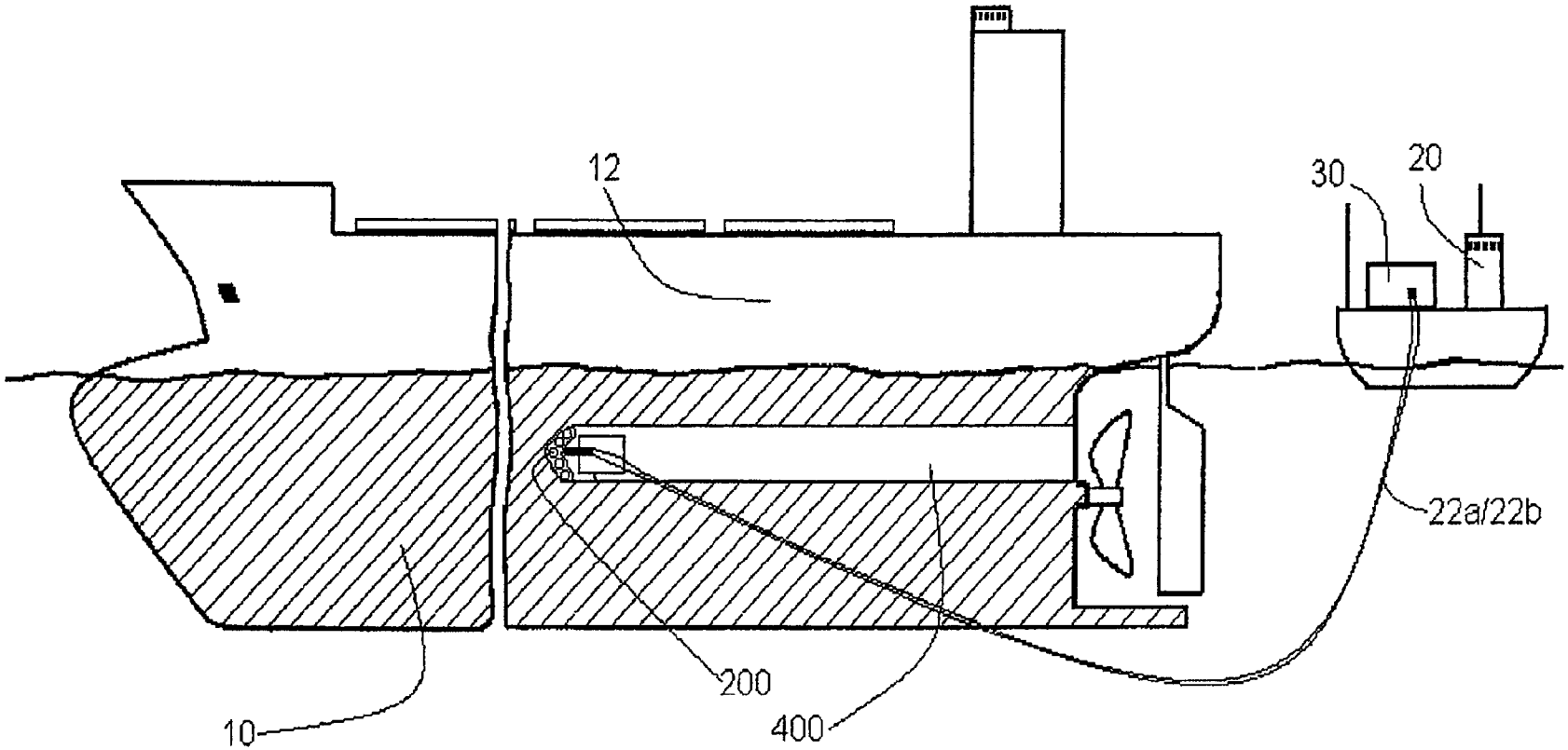

Initially, reference is made to FIG. 1. The underwater part 10 of a ship 12 is cleaned with the apparatus according to the invention. The ship lies, for example, alongside a quay or anchored in a harbour area or the like. The figure shows how the washing can be carried out.

The washing system consists of a ROV, which is a remote controlled, submersible mini submarine, and which incorporates the inventive water sucking high pressure spraying washing tool 200 that is led across the hull side 10 of the ship 12. The ROV is operated remotely from a support vessel 20 via a so-called umbilical cord which comprises power and control cables for operation of the ROV and hoses (see 22*a* in FIG. 4) for supply of cleaning fluid and removal of fouling material, respectively (see 22*b* in FIG. 4), which is sprayed off the side of the hull 10. The ROV comprises all the instrumentation which is common and necessary to steer, control and accurately manoeuvre the ROV under water, among other things a necessary number of cameras and the like such that the operators on board the support vessel 20 have full visual control of the position and movements of the ROV.

High-pressure water (seawater/fresh water) is used as cleaning fluid as this can be added to other cleaning fluids which are suitable for the surface which is to be cleaned and the fouling materials that shall be removed. The water can also be heated or supplied with solid particles such as abrasive agents.

A container 30 onboard the support vessel 20 contains;

a control room for the operation of the ROV;

a pump for supplying high pressure cleaning fluid;

and a pump for sucking up the waste water which is connected to the cleaning cups via the umbilical cord 22*b*. Furthermore, the waste water is subjected to a filtration process, where filtered waste is led to a collecting tank.

The ROV is connected to the washing tool as shown in an example in FIG. 1.

Figure 2:
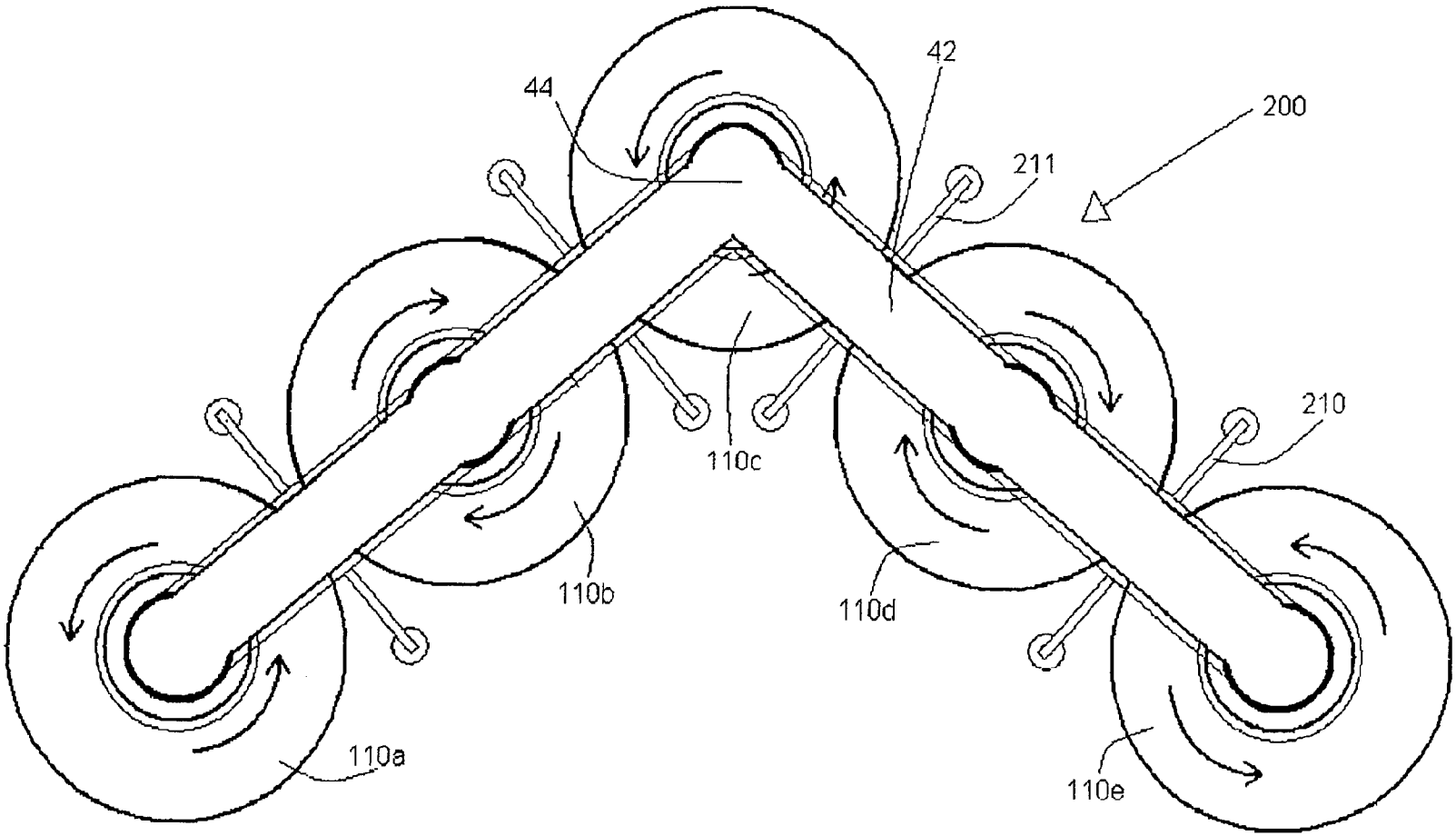
Figure 3:
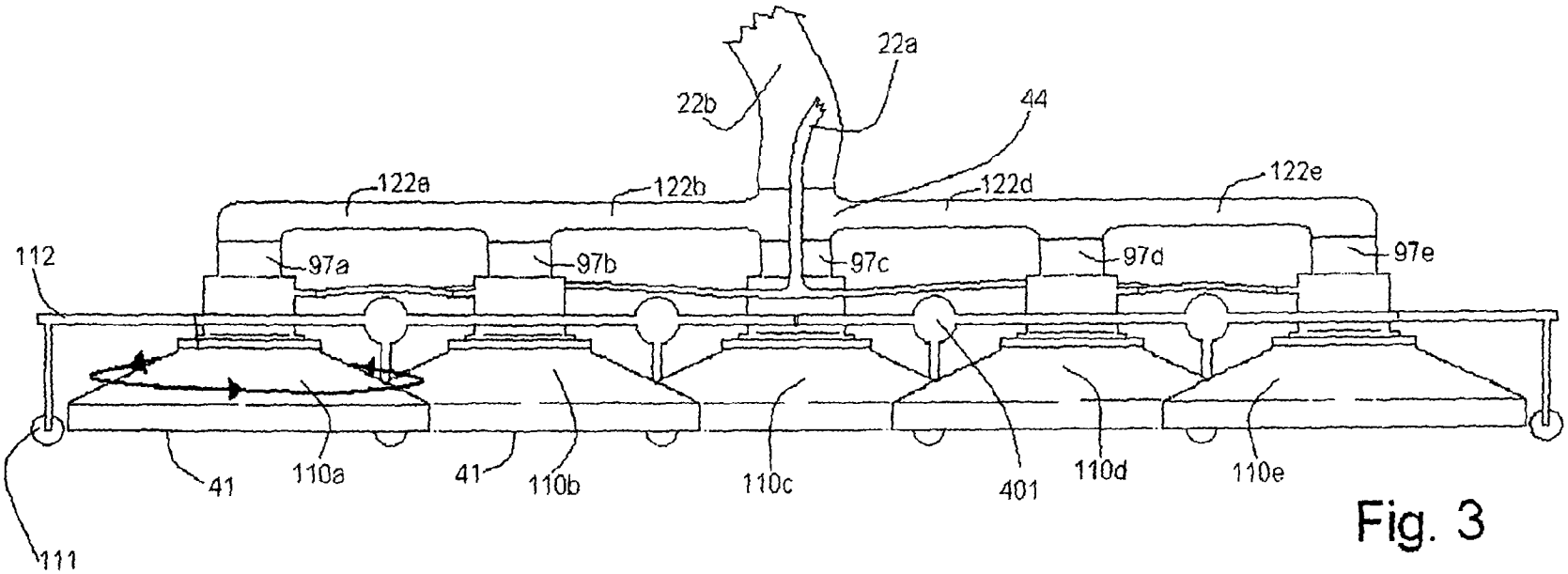

FIGS. 2 and 3 show an enlarged picture of the inventive washing tool according to the invention, viewed from above and from the side, respectively. The unit is shown without the connecting system to the ROV, pumps, hoses or other drive units.

According to this not-limiting embodiment in FIG. 2, the cleaning, sucking, high pressure washing tool comprises five rotary cups 110 which are fitted together in a trusswork frame 42, not described in detail. Each cup 110 has a cupola form or a dome form and is rotary fitted to a hollow bearing casing 97 that is fastened to the frame 112.

In the example shown, see in particular FIG. 2, the frame 112 has a V-shape, as two (110*a*-110*b* and 110*d*,110*e*, respectively) of the five cups are mounted along each leg in the V-shape, while the fifth cup 110*c* is mounted in the pointed area of the cup.

The hollow casing constitutes the drain pipe 97 from the top of each cup 110 *a-e* and runs in through the top of the cup to its inside. Furthermore, each drain pipe 97 in the frame 200 forms a channel system 123 that runs into the cup material and is set up to lead the high pressure fluid up to the nozzles at the rim of the cup 41. See FIGS. 4 and 6, in particular.

From the outlet 43 of each cup top, a hose (122*a*-122*e*) leads up to a common waste hose 22*b* which in FIG. 3 is shown to run upwards from the top part of the cup numbered 110*c*.

The figure shows this course of the hose only schematically. In a practical embodiment, the lengths of the hose runs from each cup top and up to the suction pump which establishes the underpressure ought to be of equal length so that the suction of water from the cup shall be the same.

Figure 4:
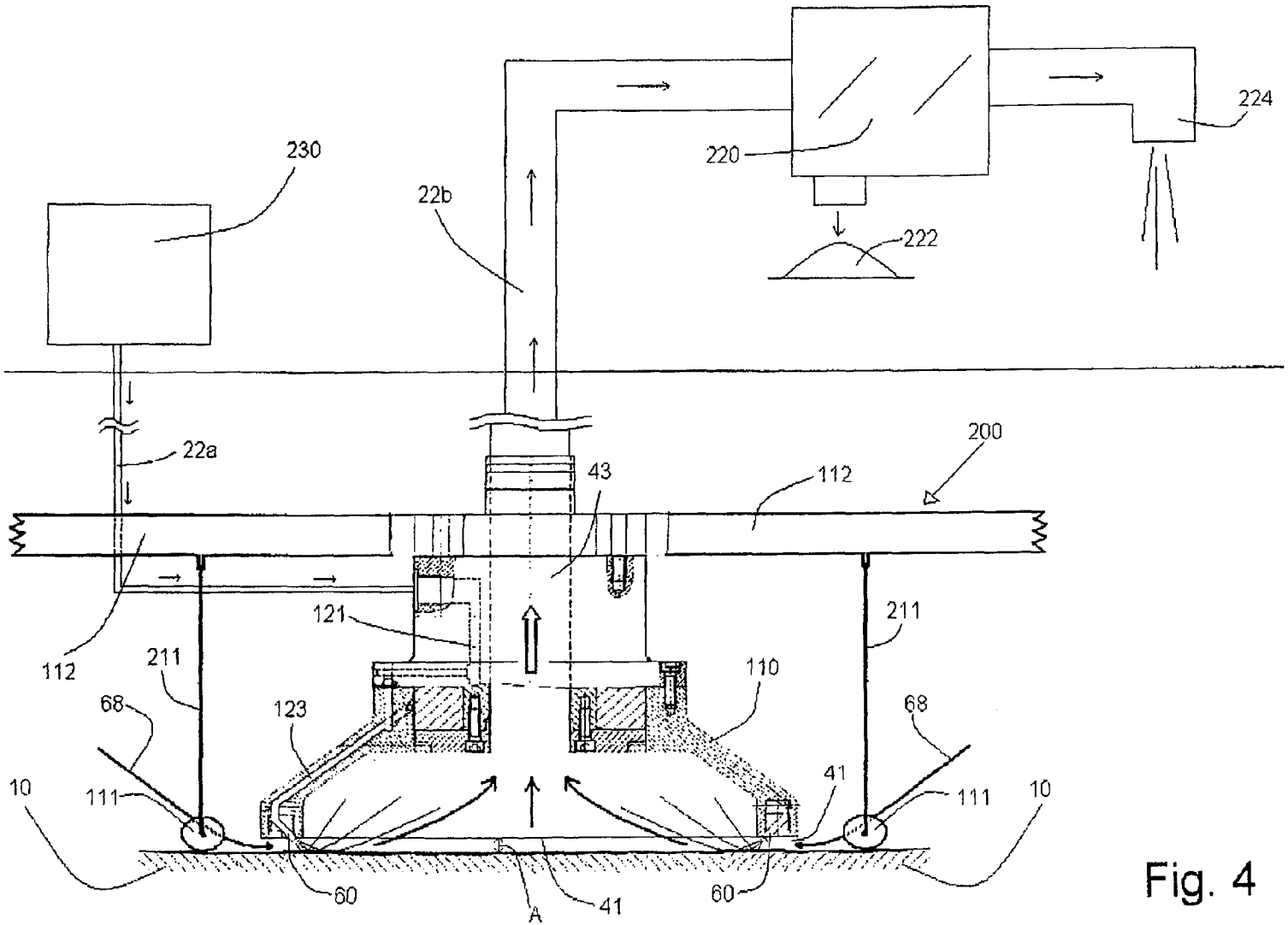
FIG. 4 shows a cross-section, partially in outline, of a system drawing of a cup. It shows how the stream of water passes through the cup from the outside, in the different phases, from spraying particles loose, via collection to further treatment where the particles are filtered from the water.

A drain hose 122 is arranged from the top of each cup with a suction device for leading away the loosened, fouling material in water to a common hose 22*b* which, in turn, leads to the support vessel 20, where the fluid is treated as shown in FIG. 4. A suction pump on the vessel 20 is also connected to help with the suction of liquid through the hose 22*b*.

The distance (A in FIG. 4) between the rim edge 41 of the cup 110 and the hull surface 10 is controlled to be between 0.1 to 10 cm. The distance is regulated in that the frame 112 that holds the cups is fitted with fenders 111 that can be regulated, for example, rubber wheels that are fitted at the end of a rod 211 arranged between each cup. Each rod 211 forms a leg fastened to the frame and extends (see FIG. 4) diagonally (see FIG. 2) down towards the wheel 111 that lays on the surface 10. The length of the rod 211 can be regulated in that it is divided in two, as the one part is a threaded rod (with the fender at the one end) that can be regulated by screwing in an internally threaded rod part fixed to the frame.

These spacers 211/111 will hold the rim edge 41 of the cup at the desired distance A from the hull surface during the travel along the underwater surface. As the distance of the nozzles to the sprayed surface is the same for all the nozzles, the same amount of water will flow into each cup at any time.

A cross section of one of the rotary cups 110 is shown in FIG. 4, i.e. one of the five cups that is mounted in the framework in the FIGS. 2 and 3.

Each cup 110 retains its shape and has a dome-form, the lower peripheral rim edge 41 of which has a distance to the washed surface where water from the outside of the cup is sucked in towards the cup outlet 43. At the top of the cup dome, a drainpipe 97 is fitted to the mouth of the hose 122 up to the suction pump that establishes a constant flow of water up to the center of the cup. The fouling material which is sprayed loose from the cleaned surface will follow the stream of water in through the drain and will be pulled further up through the connected pipeline 22*b* (i.e. via each sub-hose 122*a-e*, respectively).

The high pressure hose 22*a* leads the cleaning water from a water reservoir 230 and it leads the water up to the stationary upper part of the apparatus. The water is led in the stationary drain pipe 97 through channels 121 bored out along (axially) in the wall of the drain pipe. Furthermore, the stream of water goes through the high pressure carrying rotary bearing and out into the integrated water channel system 123 of the cup wall and finally out through the nozzles 60 that end up at the rim of the cup around its circumference.

Figure 5:
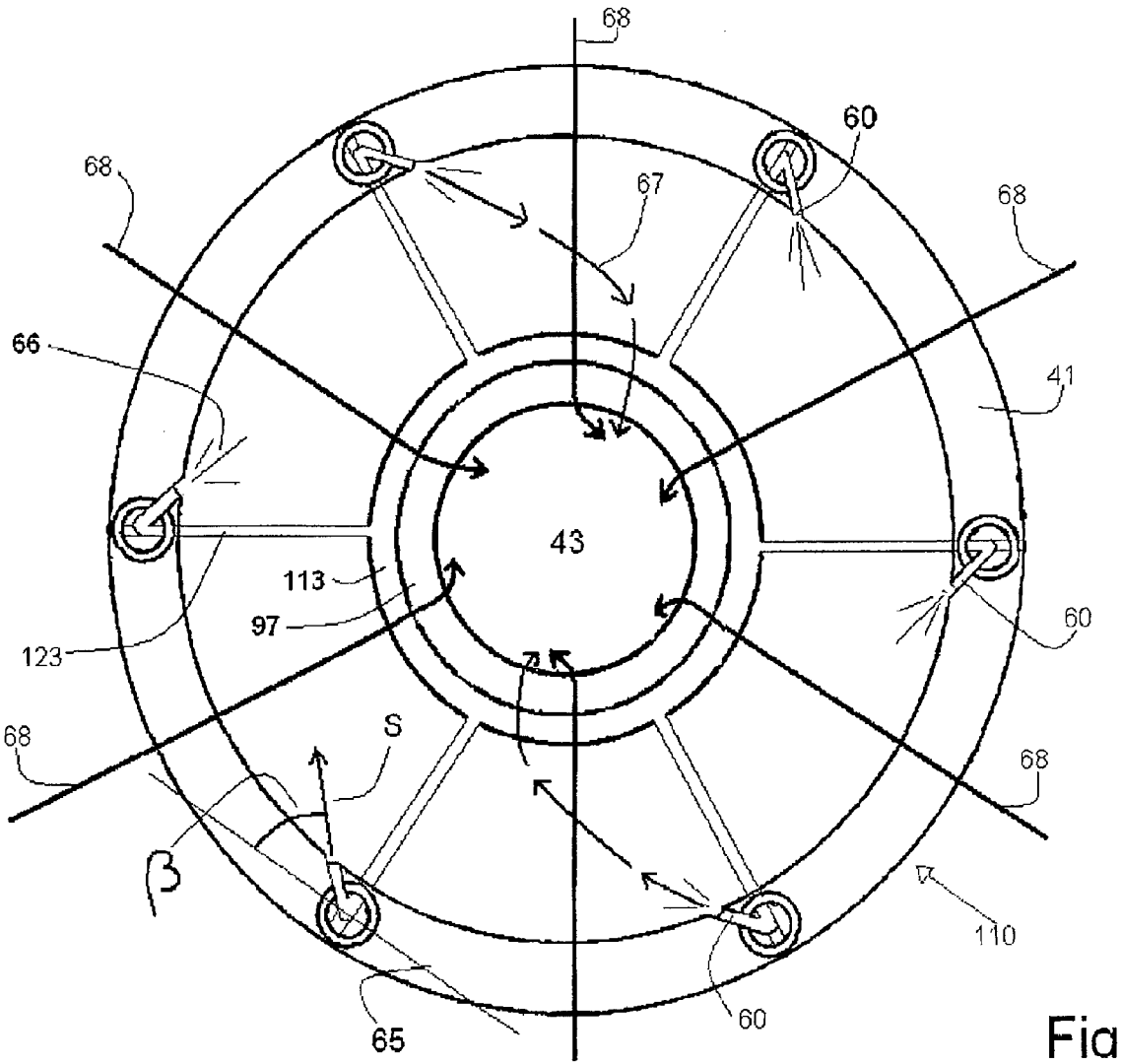
FIG. 5 shows a plane view of the underside of a cup to illustrate the flow pattern of the spraying water from the spray nozzles and the stream from the surrounding water in to the center. The rim edge 41 and the outlet 43 can be seen in the figure.
Figure 6:
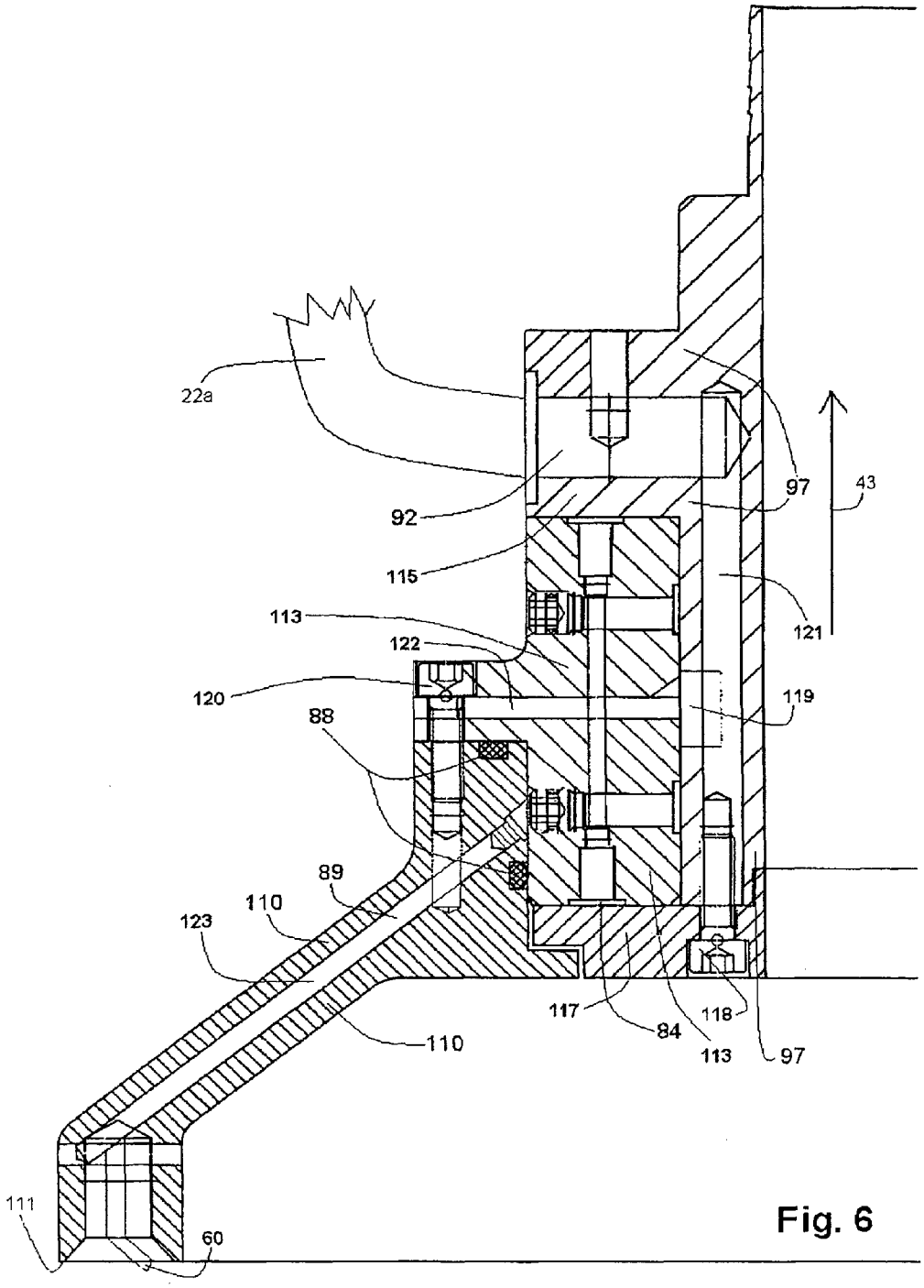
FIG. 6 shows a partial vertical view of the mounting of the cup to a bearing casing and, in addition, shows channels for supply of liquid to a cup, and the central suction pipe from the cup.

As shown in FIGS. 4, 5 and 6, the nozzles 60 point in the opposite direction of the direction of rotation so that the cup and the outer part of the bearing rotate. Furthermore, the jet nozzles are set at an angle in relation to the hull surface 10. Seen from below towards the hull surface that is cleaned, the projected angle which the jet 66 forms turned inwards in relation to the tangent to the circumference of the cup at the hull surface. Furthermore, the jet forms an angle inwards from the vertical. This means that the high pressure nozzle sprays a jet 67 (FIG. 5) at an angle approximately in towards the center of the cup. The direction of the jet can be as shown in FIGS. 4 and 5 which show the nozzles set up at an angle in towards the center in relation to the tangent to the angle of rotation. This results in the mixture of liquid and loosened fouling material being sprayed in towards the center and following the already established stream 68 of water that has a direction in towards the center of the cup and being bent upwards towards the drain 43. This results in that the mixture of liquid and loosened fouling material will flow upwards and out through the drainpipe for further transport through the hose 22*b* (via the hose parts 122). Inside the cup, a fluid dynamic underpressure is established in this way, which leads all fouling material towards the drain pipe. No fouling material can be released and contaminate the free body of water.

How the rotary cup 110 can be mounted in the stationary drain pipe 97 with the help of a water-carrying rotary bearing 113 is illustrated in detail in FIG. 6.

To illustrate how the present invention provides a stream in towards the center and upwards with the help of a fluid dynamic underpressure, reference is made to FIGS. 4 and 5.

FIG. 5 shows the cup 110 seen from below and shows the spray nozzles 60, in this case a total of six, placed around the circumference of the rim edge 41 of the cup nozzle. The suction 43 at the top of the cup is shown in the middle section.

The water jet 66 shows the sprayed out liquid that streams out of the mouth 60 of the nozzles and how it spreads out. The angle at which the jets 66 streams out of the nozzles is indicated by the symbol β, in relation to a tangent 65 to the circle drawn in as a line in FIG. 5. They tend to collect in the center and be sucked up through the suction 43.

According to the invention, the angle β can lie in the range 10-90 degrees. Furthermore, the spray can form an angle of the order of 10-80 degrees with a line vertical to the peripheral plane of the rim edge 41. This means that the high pressure nozzle sprays a jet diagonally in towards the center of the cup.

In an inwardly turned angle (10-90 degrees) the water jets spray in the relatively same direction so that rotation is set up and the cups start to rotate. Furthermore the effect is that dirt and fouling are flushed in towards the center of the cup. The nozzles are mounted at the lower part of the rotating cup which is mounted and rotates on a bearing 113 around the suction pipe 97 in the center. A water suction pump (not shown) onboard the support vessel 20 establishes an even suction in the center 43 of the device. This results in a continuous suction of fouling material and particles that are flushed loose in a mixture with water.

As can be seen in FIG. 4 the water/fouling materials are led through a particle filter 220 for separation of solid particles of the fouling material 222. Furthermore, the water can be subjected to UV radiation to kill microorganisms.

In that the cup is mounted uppermost at 88 in the rotating bearing 113, one obtains a more stable rotation of the construction. The number of nozzles and the exact spraying angle can be varied depending on the conditions and how large the apparatus shall be in total.

The Inner Construction of the Outlet Pipe 97 and the Connection to a Rotating Outer Bearing.

Reference is made to the FIGS. 4 and 6 which show vertical sections through the bearing construction comprising the solid drain pipe 97 and the outer, ring-formed, rotary bearing 113. The bearing 113 is entered onto the lower part of the drain pipe and squeezed up against a ring-formed hook-section 115 on the outside of the drain pipe 97. The upper edge of the bearing 113 lies so that it can glide against the ring-formed hook-section of the drain pipe on an established water layer which continuously lubricates the gliding surface of the bearing. Water lubrication of the bearing ensures that it can rotate with little friction and with even water lubrication in towards the drain pipe 97. The bearing 113 is kept in place to the drain pipe 43 by a ring-formed plate 117 which is screwed in with bolts 118 in the lower part of the drain pipe.

The water carrying high pressure bearing 113 is further stabilised axially out towards the inner surface of the cup 110 with the help of upper and lower sets of gaskets 88, whereupon an unspecified number of screws 120 are fitted to hold the cup 110 up to, and together with, the rotating part of the bearing 113.

The cleaning surface is supplied to the system in that the high pressure hose 22*a* is connected to a channel 92 in through the wall of the cup from the outside. The channel 92 ends up downwards in a co-axial, inner, ring-formed channel 121 in the cup pipe 97. Furthermore, the channel hits the radial, ring-formed recess 119 which is cut out in the outer wall of the cup pipe 97. Thereafter, it hits a radially directed outwardly facing boring 122 which ends up in the shiny outer side of the bearing. Such borings 122 are formed mutually spaced apart through the bearing 113 around the whole circumference while the recess 119 runs continuously round the whole circumference.

The recess 119 is level with the inlet bore 122 in the bearing 113. As it can be seen, this recess 119 is cut out with ample room in relation to the diameter of the inlet channel 122. Seen in the elevation of the drain pipe, the recess runs a distance above and below the inlet area of the channel 122 for the purpose of continuously filling all borings further out through the bearing 133 out to the water channel 123 in the cup 110 and further out through the nozzles 60.

The aim of the special construction of the inner, ring-formed, axial channel 121 and the radial borings is that the cleaning fluid can be delivered to the annular space 119 and further to the channels 122 of the bearing casing 113 at such an even pressure P as possible around the whole of the circumference. The spraying out of cleaning fluid through the nozzles will thereby be as stable and mutually even as possible. With this part of the invention, one obtains that the fluid pressure in the annular space 119 stays stable and even around the whole of the pipe circumference. The operation during rotation is thereby very stable. The extensive tests that have been carried out show clearly that the cup rotates surprisingly evenly without any sign of imbalance in the system.

Furthermore, this construction amounts to the same number of fluid-carrying, axial channels that are bored down into the solid cup material 110 whereupon they run over in the same number of sloping, drilled hole channels 123 directed to tilt outwards down towards the external edge 41 of the cup where these channels run over into the tilted nozzles 60.

According to a preferred embodiment of the invention, a given number of extra spraying nozzles that face outwards from the outer side of the cup can be fitted. These nozzles are supplied with the same fluid pressure as the internal nozzles and contribute to maintain and increase the rotational speed of the cup.

With the help of the above mentioned ROV, the washing tool is placed in towards the surface so that the support legs 211 lie against the surface. When all of the support legs lie against the hull side, all the rim edges 41 of the cup nozzles will have the same distance A to the surface 10. All the water which is sucked into the cup flows in through this gap A (FIG. 4). The underpressure which is established contributes to the cups being sucked in towards the hull side. As the suction system is set so that identical cup distance A to the hull surface 10 is established and this distance A to the surface 10 is maintained.

As the suction system is set up so that an identical cup distance A to the hull surface 10 and the same suction power from all the cups is set up, one obtains a very stable washing tool, which, to a very little extent, is subjected to vibrations.

Figure 7:
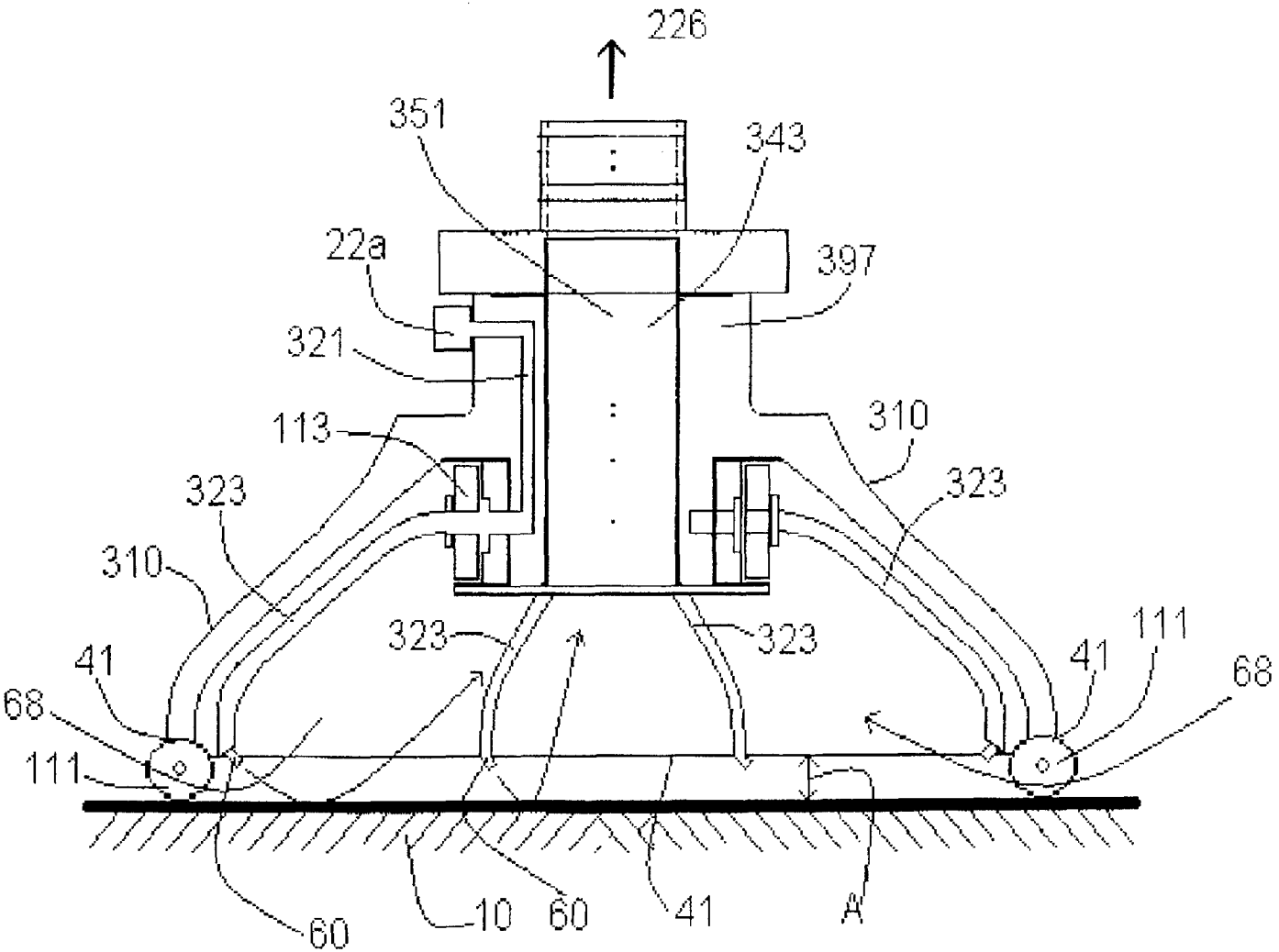
FIG. 7 shows an alternative embodiment of a cup in a washing tool according to the invention.

An alternative washing tool with cup constructions according to the invention is shown schematically in FIG. 7, in the form of a vertical section. In this version a stationary cup fixed to the frame construction is used, and it comprises internal nozzle arms mounted in a bearing which can rotate around the outlet pipe so that the arms turn around the axis so that the arms glide along the curved inner wall of the cup.

The figure shows a cup 310 which retains its shape and a number of internally rotary arch-shaped arms 323 which are hollow to supply cleaning fluid to the nozzles 60. The figure shows four such arms 323 as this solution comprises a total of six such arms.

The lower peripheral rim edge 41 comprises a number of wheels 111 or fender cushions that define the distance A between the rim edge 41 and the hull surface 10 which shall be cleaned. So that the distance A can be regulated, the wheels 111 are arranged on extended legs which are fastened to the framework as it is described in connection with the washing tool in FIGS. 2 and 3.

The cup is fixed in a casing-formed pipe 397 which further defines a drain 343 for fouling material that is sucked from the cup and which is further connected to the drain pipe 22. A ring-formed bearing 113 to which the nozzle arms 323 are fixed is rotary mounted about the outlet pipe 397. The channels for transporting the pressure fluid to the nozzle arms are led axially (at 321) through the stationary pipe part 397 up to a horizontal run through the bearing 113 and further out into the hollow nozzle arm 323. The fluid is distributed to the six nozzle arms with the help of the same construction in the fixed and the rotary parts of the mounting to the pipe 397.

The pipes 323 run in an arch-shape down along the inner wall of the cup 310 and end up in an adjustable tilted nozzle 60. The spraying out of the fluid provides the drive power for the whole of the grommet 113 with all the nozzle pipes to rotate about the axis 351.

Furthermore, the jet nozzles are set at an angle tilted in relation to the hull surface 10 in a way corresponding to the first alternative given above in this description. Seen from above towards the side of the hull which is being cleaned, the projected angle which the jet forms is 10-80 degrees with the tangent to the circumference of the cup at the hull surface. Furthermore, the jet forms an angle of the order of 10-90 degrees deviation from the vertical 51. This means that the high pressure nozzle sprays a jet diagonally in the direction of the center of the cup. The direction of the jet can be set up at an angle in towards the center in relation to the tangent to the circle of rotation. This leads to the mixture of liquid and fouling material that has come loose running together with the water 68 which is sucked in under the rim edge of the cup and is pulled up towards the outlet 43 from the top. The mixture streams up and out through the drain pipe 397 for further transport through the hose 22.

According to tests that shall not be considered to be limiting for the present invention, a fluid dynamic underpressure in the inner, central outlet of the cup, and the ratio between the volume of the cleaning fluid which is sprayed out through the nozzles and the volume of water which is sucked in from the surroundings of the cup is of the order 1:10 to 5:10.

In a practical experiment, two cleaning tests were carried out with the prototypes of the two versions of the washing tool. Washing tools were used with cup sizes in the range 10 cm to 1 meter. The tests were carried out on the submerged part of the hull of a ship lying in a harbour. The volume of fluid sprayed out from each cup was set at about 20 litres per minute at a water pressure of about 300 bar, and the suction of external water, adjusted by the suction from the pipe 22, was controlled to about 100 litres per minute. An examination of the hull surface afterwards showed that it was completely free of fouling material and growth. By collecting and treating of the water in a cleaning unit 220 (FIG. 4), all microorganisms were killed. There were no traces of live microorganisms in the water that was let back into the sea through the outlet 224 in FIG. 4.

The conclusion is that the washing tool according to the invention represents a considerable step forward in this area.

The invention claimed is:

1. Apparatus for loosening and removing fouling material from a surface lying under water, comprising a frame construction with a number of washing apparatus and set up to be brought up to the surface, means for supply of a watery cleaning fluid to the washing apparatus for spraying out so that the washing apparatus are made to rotate and to loosen fouling material from the surface, and outlets to bring the mixture of fluid and fouling material to further treatment, characterised in that each washing apparatus is in the form of a cup having a dome shape with integrated channels for supply of fluid to integrated spraying nozzles arranged around a lower rim edge of the cup and set at an angle towards a center of said cup, said spraying nozzles being set at an angle seen from above towards the surface so that a jet of water from each respective Spraying nozzle forms a projected angle β of the order of 10-90° with the tangent to the cup circumference at the surface, and also that each respective jet forms an angle of the order of 10-80° with a line vertical to the peripheral plane of said rim edge, said cup having a central outlet at the top section of said cup for suction of fluid and fouling material, that said cup is set up to rotate as a consequence of the spraying out of fluid, that said rim edge of said cup is set up to be brought a given distance (A) from the surface so that said outlet is arranged at the top part of the central section of said cup and is connected to a body which can establish the suction of fluid out from the inside of said cup so that fluid can flow into said cup through the gap (A) between the surface and said rim edge and characterised in that said cup is adjusted to be set against the surface and a suction pump establishes a fluid dynamic underpressure in the inner, central outlet of said cup, and the ratio between the volume of cleaning fluid which is sprayed out through said nozzles and the volume of water which is sucked in from the surroundings of said cup is of the order of 1:10 to 5:10 and in that said cup is arranged to be brought with the edge of the rim at a constant distance (A) to a hull surface, said distance is controlled by adjustable length spacers fitted in the frame construction, the spacers comprising a fender or a wheel set up to lie against, and move along, the hull surface when the frame construction is moved.

2. Apparatus according to claim 1, characterised in that the distance (A) is set in the range 0.1 to 10 cm.

3. Apparatus for loosening and removing fouling material from a surface lying under water, comprising a frame construction with a number of washing apparatus and set up to be brought up to the surface, means for supply of a watery cleaning fluid to the washing apparatus for spraying out so that the washing apparatus are made to rotate and to loosen fouling material from the surface, and outlets to bring the mixture of fluid and fouling material to further treatment, characterised in that each washing apparatus is in the form of a cup with integrated channels for supply of fluid to integrated spraying nozzles arranged around the rim edge of the cup, and comprises a central outlet at the top of said cup for suction of fluid and fouling material, that said cup is set up to rotate as a consequence of the spraying out of fluid, that said rim edge of said cup is set up to be brought a given distance (A) from the surface so that the outlet is arranged at the top part of the central section of said cup and is connected to a body which can establish the suction of fluid out from the inside of said cup so that fluid can flow into said cup through the gap (A) between the surface and said rim edge characterised in that a casing at the top section of said cup defines both a central outlet connected to a hose for removal of fouling material and also a co-axially, externally arranged inlet for cleaning fluid to the nozzles, and said cup is rotary mounted to the outside of the casing via a gliding connection.

4. Apparatus according to claim 3, characterised in that said inlet defines a channel system that transports the cleaning fluid to the channels/nozzles and comprises an axially arranged ring-formed channel in said casing which in turn forms a fluid connection with the fluid channels to the nozzles.

5. Apparatus according to claim 1, characterised in that the frame construction is a trusswork frame which comprises a plurality of said cups arranged mutually spaced apart in the frame.

6. Apparatus according to claim 5, characterised in that said frame construction has a V-shape which supports five cups where two of the five cups are fitted along each leg of the V-shape, while the fifth cup is connected to the point area of said frame construction.

7. Apparatus for loosening and removing fouling material from a surface lying under water, comprising a frame construction with a number of washing apparatus and set up to be brought to the surface, means for supply of a watery cleaning fluid to the washing apparatus for spraying to loosen the fouling material from the surface, and outlets to bring the mixture of fluid and fouling material to further treatment, characterised in that each washing apparatus comprises a cup having a dome shape with internally arranged rotary arms with channels for supplying cleaning fluid to spraying nozzles where said cup is set up to be placed with its rim edge a distance (A) from the surface, said arms being rotatable along an internal surface of said cup and being anchored in a grommet which is rotary mounted to an outlet-forming pipe and said nozzles being set at an angle towards the surface so that the mixture of fouling material and fluid follows the established stream of water up in the center of said cup, means for supply of the cleaning fluid to the nozzles for spraying the surface to loosen the fouling material and to get the nozzles to rotate inside said cup, an outlet at the top part of the central section of said cup and which is connected to a suction body that can pull water from the inside of said cup so that water can flow into said cup through the gap (A) between the surface and the rim edge, and a casing at the top of said cup defining both a central suction outlet and a co-axial, externally arranged annular space-forming chamber for fluid supply, and each rotary arm is mounted to rotate to the outside of casing via said grommet and has fluid connection to the annular space-forming fluid supply pipe via a gliding connection.

8. Apparatus according to claim 7, further comprising a rotary casing where the nozzles run straight down alongside said central suction outlet and is set up to rotate like a propeller in the middle and pushes the fouling material behind and up into said central suction outlet.

9. Apparatus for loosening and removing fouling material from a surface lying under water, comprising a frame construction with a number of washing apparatus and set up to be brought to the surface, means for supply of a watery cleaning fluid to the washing apparatus for spraying to loosen the fouling material from the surface, and outlets to bring the mixture of fluid and fouling material to further treatment, characterised in that each washing apparatus comprises a cup with internally arranged rotary arms with spraying nozzles where said cup is set up to be placed with its rim edge a distance (A) from the surface, means for supply of the cleaning fluid to the nozzles for spraying the surface to loosen the fouling material and to get the nozzles to rotate inside said cup, an outlet at the top part of the central section of said cup and which is connected to a suction body that can pull water from the inside of said cup so that water can flow into said cup through the gap (A) between the surface and said rim edge and further characterised in that said cup is set up to be brought with its rim edge to a constant distance (A) from the surface, said distance being controlled by adjustable length spacers fitted in said frame construction, with each spacer being a rod having a free end which comprises a fender or a wheel set up to lie against, and move along, a hull surface when said frame construction is moved along the surface.

10. Apparatus according to claim 9, characterised in that the distance (A) is set in the range 0.1 to 10 cm.

* * * * *